US007040800B2

(12) United States Patent
Brauch et al.

(10) Patent No.: US 7,040,800 B2
(45) Date of Patent: May 9, 2006

(54) MAGNETIC STIRRER WITH A STIRRING DRIVE IN THE FORM OF MAGNETIC COILS

(75) Inventors: Uwe Brauch, Heitersheim (DE); Hans König, Seefelden (DE)

(73) Assignee: IKA-Werke GmbH & Co. KG, Staufen (DE)

( * ) Notice: Subject to any disclaimer, the term of this patent is extended or adjusted under 35 U.S.C. 154(b) by 187 days.

(21) Appl. No.: 10/764,097

(22) Filed: Jan. 23, 2004

(65) Prior Publication Data

US 2005/0088912 A1 Apr. 28, 2005

(30) Foreign Application Priority Data

Oct. 27, 2003 (DE) ..... 203 16 560 U

(51) Int. Cl.
*B01F 13/08* (2006.01)

(52) U.S. Cl. ..... 366/274

(58) Field of Classification Search ..... 366/273, 366/274

See application file for complete search history.

(56) References Cited

U.S. PATENT DOCUMENTS 4,568,195 A * 2/1986 Herz et al. ..... 366/274
4,991,973 A * 2/1991 Maaz et al. ..... 366/141

FOREIGN PATENT DOCUMENTS

| | | |
|---|---|---|
| DE | 81 06 555.8 | 11/1981 |
| DE | 32 48 455 | 7/1984 |
| DE | 32 48 455 A1 | 7/1984 |
| DE | 42 01 693 | 4/1993 |
| DE | 94 00 471.4 | 6/1994 |

* cited by examiner

*Primary Examiner*—David Sorkin
(74) *Attorney, Agent, or Firm*—Volpe And Koenig, P.C.

(57) ABSTRACT

A magnetic stirrer is provided having a minimal overall height so that it is approximately plate-like and flat and its electrical stirring drive formed by magnetic coils is arranged with the driving ends of the magnetic coils approximately flush with the circuit board with the control circuit, wherein the axial dimension of the magnetic coils is smaller than its diameter. In addition, a cover made from non-ferromagnetic material, especially an adhesive film, which tightly seals the housing, is arranged over, and adhered to, the surface of the circuit board and the driving ends of the magnetic coils and lies in a common plane with an outer border of the housing.

20 Claims, 5 Drawing Sheets

Fig.5
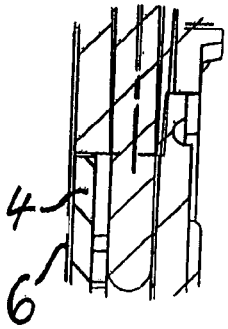
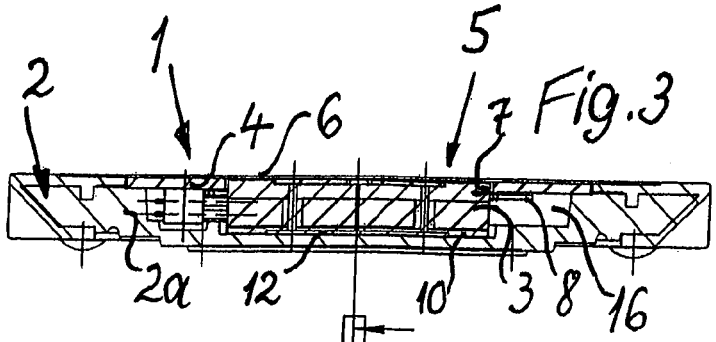
Fig.3
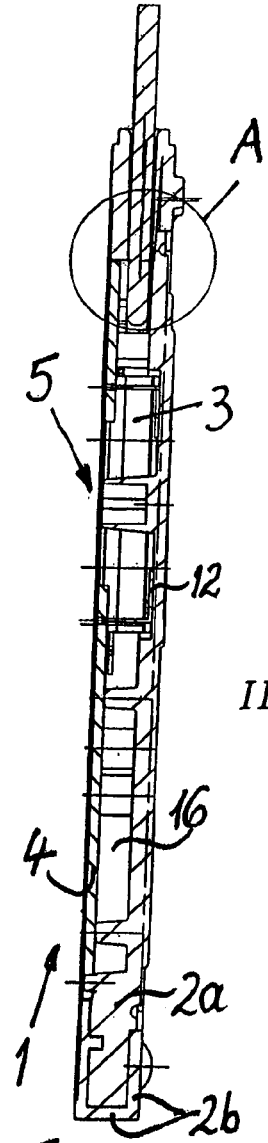
Fig.4
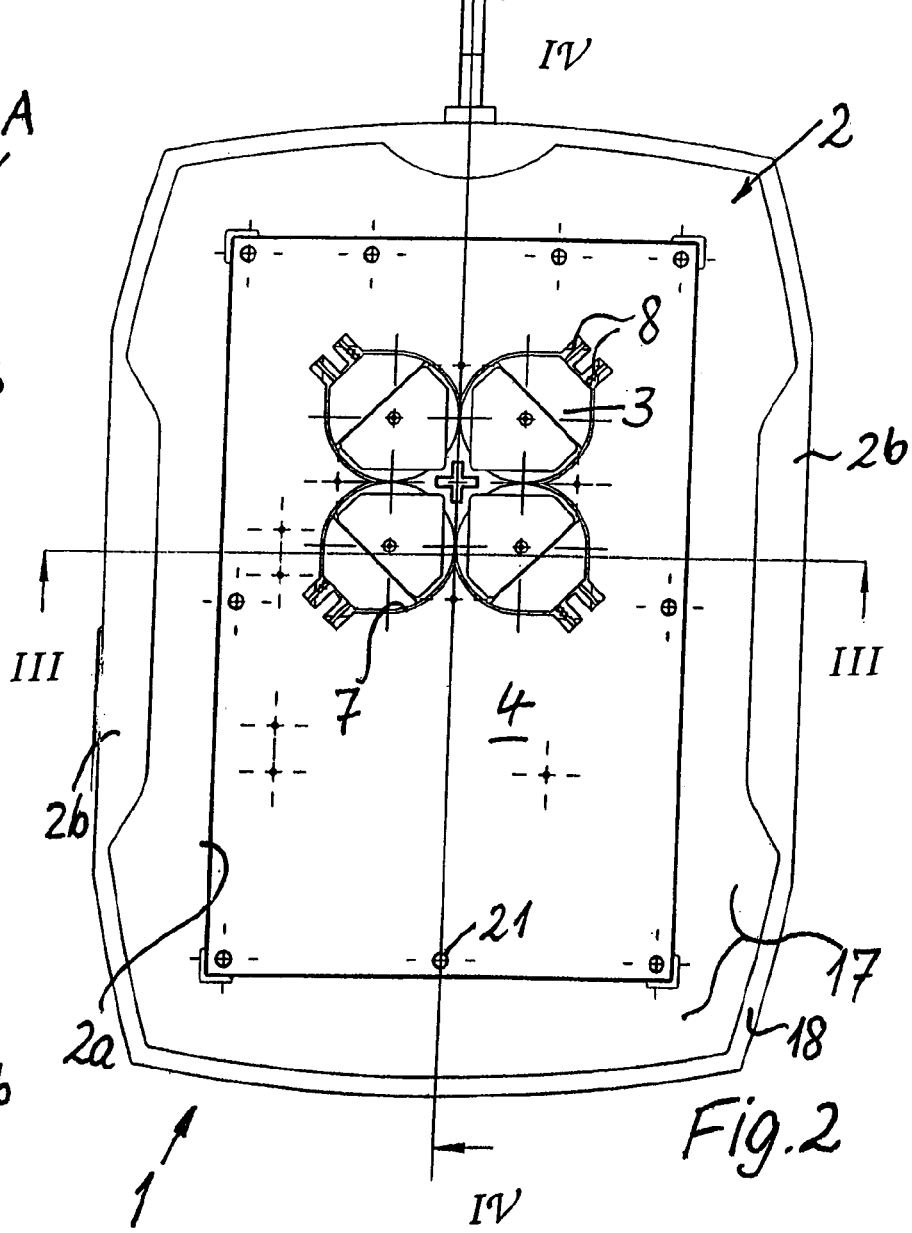
Fig.2

MAGNETIC STIRRER WITH A STIRRING DRIVE IN THE FORM OF MAGNETIC COILS

BACKGROUND

The invention relates to a magnetic stirrer with a housing, which accommodates an electric stirring drive in the form of alternately excitable magnetic coils or electromagnets as well as at least one circuit board having a control circuit with control components mounted on this circuit board for the stirring drive, and with a top, essentially horizontal contact surface for a container holding the goods to be stirred and also a stirring magnet, wherein the magnetic coils are arranged underneath the contact surface and one of their ends is turned towards the contact surface as the driving end.

Such magnetic stirrers have been known for a long time, e.g., from DE 32 48 455 A1, and have been proven in practice. Magnetic coils or electromagnets with alternately rotating magnetic fields avoid the use of rotatable parts, so that wear and maintenance are reduced relative to a magnetic stirrer with a drive motor and a rotatable magnet.

However, due to the power requirements on the magnetic coils, such magnetic stirrers have a nontrivial overall height, which means they have correspondingly large space requirements in laboratories.

SUMMARY

Therefore, the object is to create a magnetic stirrer of the type mentioned in the introduction, which has a smaller overall height and thus correspondingly smaller space requirements in the height dimension.

To solve this apparently contradictory object, the magnetic stirrer defined in the introduction is characterized in that the driving ends of the magnetic coils are approximately flush with the circuit boards having the control circuit, the axial dimension of the magnetic coils is smaller than its diameter, thus the magnetic coils are flat, and a cover made from non-ferromagnetic material is arranged directly on or above the circuit board and the driving ends of the magnetic coils.

Through the approximately flush arrangement of the driving ends of the magnetic coils or electromagnets with the circuit board having the control circuit and the control components, the thickness of this circuit board can be exploited so that the final magnetic stirrer is smaller accordingly. Simultaneously, this flat construction is supported by the correspondingly flat magnetic coils, which likewise reduces overall height. Further, the cover can be arranged directly on the circuit board and the driving ends of the magnetic coils, which also contributes to the small overall height between the bottom side of the magnetic stirrer and the top side of this cover.

An even better use of space and thus an even lower overall height for the magnetic stirrer can be achieved if the driving ends of the magnetic coils, which are arranged in a common plane, are arranged in the plane of the top side of the control circuit board, which faces the contact surface and which is horizontal in the usable position. Because a control circuit board with a certain thickness is necessary, but also because the driving ends of the electromagnets are as close as possible to the contact surface of the magnetic stirrer, the mentioned measures have the effect that the electromagnets require no additional height because they can be arranged flush with the top side of the circuit board.

Here, the magnetic coils can project downwards past the control circuit board in the usable position. Thus, with the driving ends of the magnetic coils, the top side of the control circuit board forms a flat overall surface, which also has only a thin cover, so that an extremely low overall height is possible relative to conventional magnetic stirrers. For this purpose, it helps that the magnetic coils or electromagnets themselves projecting downwards past the control circuit board can be very flat and require no more or barely any more room than the control elements also located on the bottom side of the circuit board and can be adapted in their overall height to the overall height of the control elements or can have the approximate overall height of these elements.

It is especially advantageous for good use of space and simultaneously the best possible electrical connection between the magnetic coils and the circuit board with the control circuit, especially as a printed circuit, if the magnetic coils, which are arranged with their axes parallel to each other and which are arranged with their driving ends in the same plane, engage in a recess or in a through hole in the circuit board, filling these especially up to an edge spacing, and the printed circuit of the circuit board is preferably connected directly to the electrical connections of the magnetic coils. Then the magnetic coils and the circuit board can be arranged in the tightest space possible and can be electrically connected without requiring specially routed lines for connecting the control system to the magnetic coils in the interior of the housing of the magnetic stirrer. Instead, both the electromagnets and also the control components, which each project out from the same side of the circuit board, namely the bottom side, can be soldered together, if necessary, to this circuit board.

Here, it is advantageous if the conductor tracks of the printed circuit form through-hole contacts from the top side to the bottom side in the region of the connections of the electromagnets and are connected or soldered on the bottom side of the circuit board with the control components to the connections of the electromagnets. In this way, the soldering of the control components and the electromagnets to the conductor tracks and contacts of the circuit board can be performed easily, quickly, and efficiently.

The magnetic coils can each be wound on a plastic sleeve or the like and arranged between two plastic end covers, wherein the plastic cover facing away from the driving end can have a grounding plate, which connects the magnetic coils, which is especially countersunk into the plastic covers, saving overall height, and which is connected and preferably riveted to the ferromagnetic cores of the magnetic coils, which are located within the plastic sleeves holding the windings. These measures contribute to the fact that the electromagnets or magnetic coils can have an axial direction that is as short or flat as possible.

The ferromagnetic cores of the magnetic coils can reach up to the driving ends and can be connected, e.g., riveted, there to flat pole plates or pole shoes, which are especially flush with the plastic covers arranged on the driving end and especially with the top side of the circuit board. The advantageously annular grounding plate and the pole shoes can thus also be connected, especially riveted, to each other through the ferromagnetic cores, and therefore can be held together. This produces in the tightest space possible an effective magnetic connection and a good guidance of the magnetic forces to the driving ends of the magnetic coils without requiring a large overall height.

The diameter of the windings of the magnetic coils can be approximately twice as large as the axial dimension or larger and can especially equal approximately three times the axial dimension of the magnetic coils. This represents a good compromise between the smallest possible overall height and not too a large lateral expansion for good magnetic coil output.

An especially advantageous configuration of the magnetic stirrer according to the invention in the sense of the smallest possible overall height is that the especially thin cover made from non-ferromagnetic material is a film, especially a plastic film. Such a film can actually be made very thin and still be used as a sufficient cover, because the forces exerted when set on a stirring container can be received very well by the electromagnets and their support in the housing. Thus, practically no additional overall height is necessary for the cover and at the same time, this cover is very cost-effective. Further, this produces another configuration possibility accordingly, in that this cover or cover film can have a printable and/or writable surface. Thus, it is possible to print or to write on the very flat and thus possibly inconspicuous magnetic stirrer with arbitrary or different patterns according to the wishes of the applicant or user and especially also conspicuously.

For another configuration of the magnetic stirrer in a construction that is as flat as possible with good operability, the control contacts for the magnetic stirrer are arranged on the top side of the control circuit board and are covered by the cover formed especially as a film. In addition, in the region of the control contacts the cover has conductive material or a conductive print on its bottom side facing the control contacts, because the cover or film itself is not electrically conductive, and in the original position between this conductive region and the opposing control contacts there is a spacing that can be eliminated by pressure. Thus, practically no additional overall height is needed also for the control contacts and they can be arranged in an easy-to-realize form on the top side practically in the plane of the contact surface of the magnetic stirrer. In order to activate these contacts, it is sufficient to eliminate the spacing between the cover and the control contacts located on the circuit board through pressure, whereby the conductive bottom side comes into contact with the control contacts and short circuits these in the sense of a control signal.

Here, it is advantageous if the cover or film is embossed and arched in the region of the control contacts and also if it can be pressed elastically and brought into contact with the control contact/s with the conductive bottom side of the film in the embossed region. Thus, it is sufficient if the spacing between the cover and the control contacts located on the circuit board is formed by arches and only in certain positions, so that these points can be easily identified by the user as push-button control elements. Here, a very flat arch is sufficient, so that the overall height of the magnetic stirrer is practically not enlarged at all.

The housing of the magnetic stirrer can be formed from at least one plastic body with a recess for holding the control circuit board and the magnetic coil. There is a border enclosing the recess, which is initially open towards the top and which is closed and covered by the cover or film in the usable position. Thus, the housing can be a very flat plastic part with an advantageously center recess approximately corresponding to the contours of the circuit board and its additional parts, in which the circuit board with the associated systems and especially with the electromagnets can be inserted from above, whereby the assembly is practically completed just by applying the cover or film.

The cover or film can be connected or adhered at least to the enclosing border of the housing, particularly also to the control circuit board and/or the driving ends of the magnetic coils or electromagnets. Thus, for closing the housing, the cover or film can be simply adhered both to the border of the housing and also to the control circuit board and the driving ends of the magnetic coils, wherein an adhesion with all of these flush parts produces a flat sealing surface and simultaneously a good attachment, which also avoids the risk of forming arches or folds in the cover or film. Here, it is advantageous if the enclosing border of the housing is arranged in a common plane with the top side of the circuit board and/or the driving ends of the magnetic coils, in order to form a contact or adhesive surface that is as uniform as possible and essentially continuous for the cover or film.

The plastic body used as the housing can have a higher electrical conductivity value relative to typical conductivity values of plastics and a connection for a grounding line. Therefore, the flat magnetic stirrer according to the invention can easily satisfy explosion protection regulations when a corresponding grounding line is attached.

An advantageous configuration of the magnetic stirrer according to the invention can provide good stability and resistance to sliding such that the housing has an inner housing part with a recess for the circuit board and the electromagnets made from hard plastic and this inner housing part is embedded at least in certain regions in an external housing part made from softer material or plastic. Here, this can be achieved through subsequent insertion of the inner housing part into the outer housing part or through molding of the inner housing part or possibly even through simultaneous injection molding of both housing parts made from different plastic components.

The control circuit board can be connected to the housing and/or to the housing part with the recess through a clamp. There, it is also fixed in the horizontal direction, while it can be fixed in the vertical direction primarily through the cover or plastic film and the adhesion of these parts.

For example, projections or pins or the like can be arranged, especially integrally, on the housing part. The projections extend outwards and engage tightly in matching recesses, holes or through holes in the circuit board in the usable position. Thus, the board only needs to be inserted from above into the recess or depression and pushed and fixed with its recesses, holes, or through holes over the corresponding projections or pins in order to create the desired attachment, whereby then the final fixing can be performed with the help of the adhesive cover or film.

Primarily for the combination of individual or several of the previously described features and means, a magnetic stirrer is produced, which is simple in its construction and which can have a very low overall height of between less than one and a half cm to approximately only slightly more than one cm due to the skillful use of space and arrangement of the magnetic coils relative to the circuit board with the control circuit. However, a somewhat larger overall height for a considerably more powerful magnetic stirrer is also conceivable, which, however, is still small relative to magnetic stirrers of comparable output with conventional constructions.

It should also be mentioned that a continuous top side of the magnetic stirrer, which has as few projections as possible and for which the contact surface and all adjacent areas lie practically in one common plane, is produced if on the border of the housing supporting the cover or film there is a raised, preferably enclosed sealing edge, which essentially transforms on the outer sides into the side surfaces of the housing and whose height corresponds approximately to the thickness of the cover, so that its surface is essentially flush with the surface of this sealing edge. This also makes it easier to correctly position the cover or film, guided by this sealing edge, during application, especially during adhesion, wherein it is favorable if the film acting as the cover is an adhesive film.

BRIEF DESCRIPTION OF THE DRAWINGS

An embodiment of the invention is described below in more detail with reference to the drawing. Shown in partially schematic representations are:

FIG. 2, is a top view of the magnetic stirrer according to the invention without the cover film, FIG. 3, is a cross section of the magnetic stirrer taken along line III—III in FIG. 1 through two adjacent magnetic coils, whose driving ends and pole shoes provided there are flush with the surface of the circuit board with the control circuit, FIG. 4, is a longitudinal section through the flat, plate-like magnetic stirrer according to the invention taken along line IV—IV in FIG. 2, FIG. 5, is an enlarged view of the detail specified by the circle referring to FIG. 5 in FIG. 4 with a border of the control circuit board, whose top side is flush with an enclosing housing border, which holds the thin cover or film.

DETAILED DESCRIPTION OF THE DISCLOSURE

Figure 1:
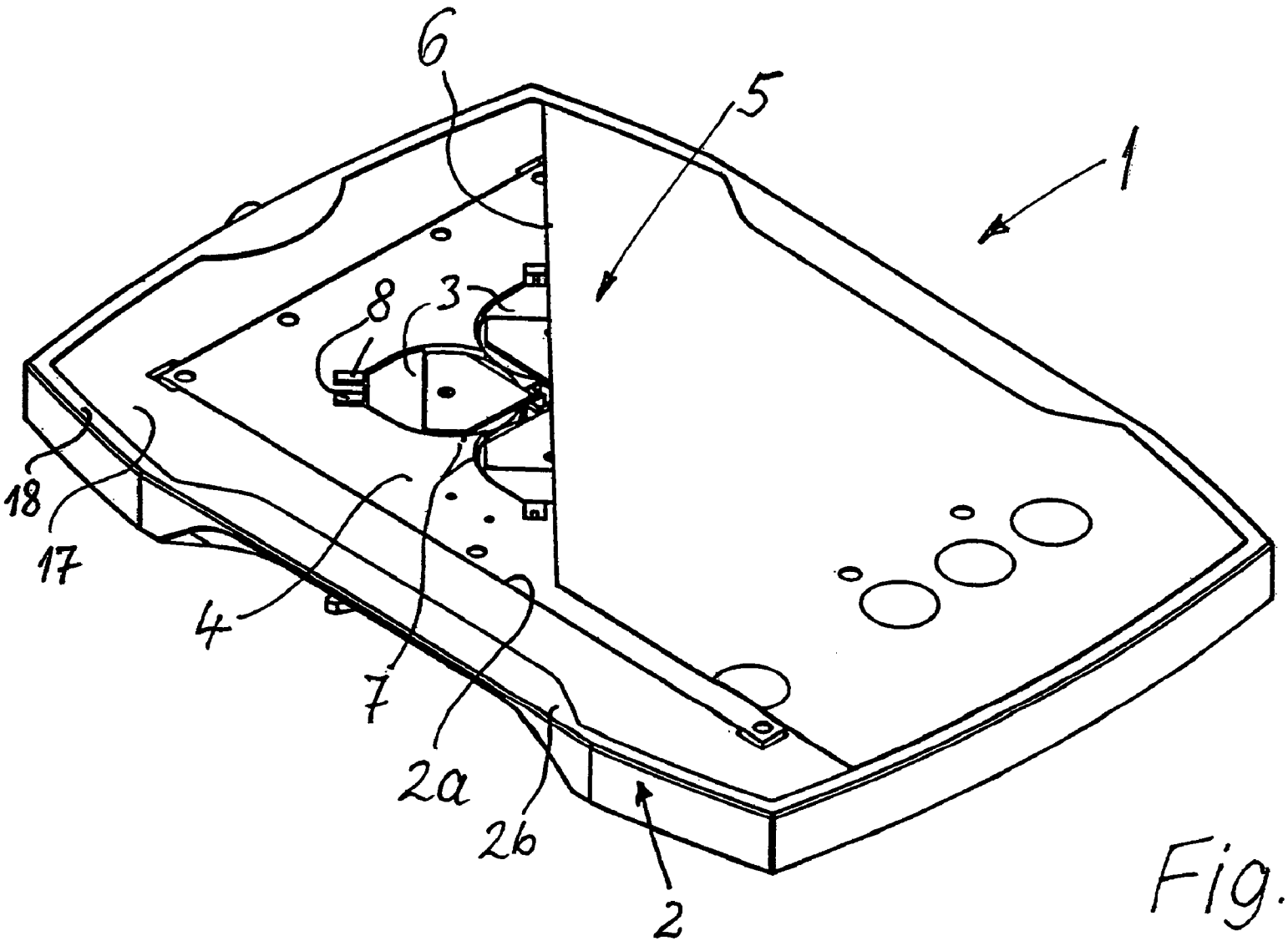
FIG. 1, is a graphical representation, particularly of the top side of a magnetic stirrer according to the invention, wherein the top, thin cover is only partially represented and is cut away, so that also a part of the control circuit board with the driving ends of the magnetic coils, which are flush with the top side of this circuit board, can be seen.

A magnetic stirrer designated as a whole by 1 has in a housing 2 an electrical stirring drive, in the embodiment in the form of four alternately excitable magnetic coils 3 or electromagnets, as well as a circuit board 4 having a control circuit with control components, which are mounted on this board and which are not shown for reasons of better visibility.

Typically, the magnetic stirrer 1 has a top, horizontal contact surface 5 above the magnetic coils 3, on which a container holding the goods to be stirred as well as a stirring magnet are arranged in the usable position. The magnetic coils 3 are thus arranged as close as possible underneath this contact surface 5 in order to be able to transmit the magnetic forces as best as possible. Accordingly, the top ends of the magnetic coils 3 are arranged as the driving end parallel to this contact surface 5.

Here, one can see primarily in FIGS. 3 and 4, but also in FIG. 1, that these driving ends of the magnetic coils 3, thus their topmost end surfaces, are flush with the circuit board 4 with the control circuit and with the top side or surface of this circuit board 4 in the usable position, so that the thickness of this circuit board 4 is used such that the axial extent or dimension of the magnetic coils 3 is accommodated spatially and the overall height is reduced.

Figure 8:
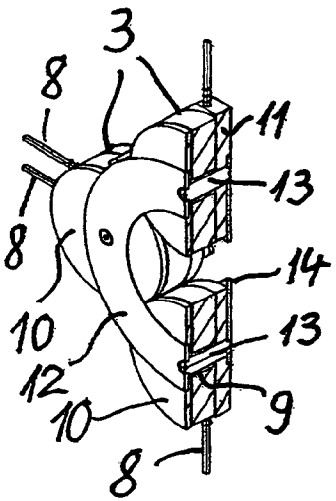
Figure 7:
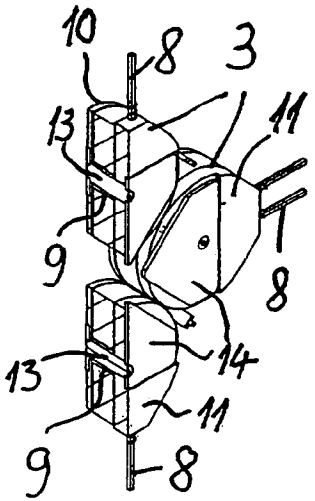
FIG. 7, is a graphical representation of the top view of a cross section of the magnetic coils taken along line I—I in FIG. 6, FIG. 8, is a graphical representation of the bottom side of the magnetic coils shown in section taken along line I—I with an enclosed, annular grounding plate, which connects the magnetic coils.
Figure 6:
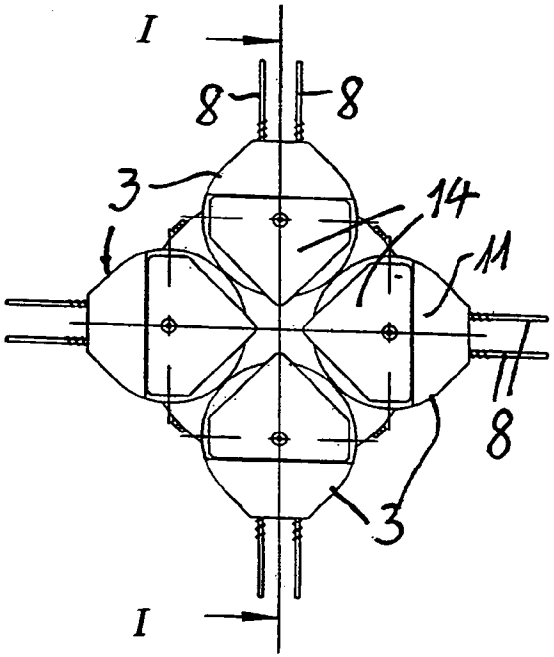
FIG. 6, is a top view of the magnetic coils that form the stirring drive which can be excited in an alternating pattern on their driving ends and the pole shoes provided there.

One can further see, primarily in FIGS. 7 and 8, that the axial dimension of the magnetic coils 3 is less than its diameter, wherein one portion of this axial dimension of the magnetic coils projects downwards relative to the circuit board 4 according to FIGS. 3 and 4. According to FIGS. 1–5 and also 9–11, there is a cover 6 made from non-ferromagnetic material, e.g., a plastic film or adhesive film, located directly on the circuit board 4 and the flush driving ends of the magnetic coils 3. This cover 6 contributes little to the overall thickness of the magnetic stirrer 1.

Since the driving ends of the magnetic coils 3 and the top side of the control circuit board 4, which faces the contact surface and which is horizontal in the usable position, are arranged in one plane, the cover 6 can cover the magnetic coils 3 and the control circuit board 4 continuously and smoothly and can produce a smooth, flat contact surface 5 according to FIGS. 1, 3, and 4.

One can see, primarily in FIGS. 1 and 2, that the magnetic coils 3, which are arranged with their axes parallel to each other and with their driving ends in the same plane, engage in a recess 7 or a through hole in the circuit board 4, this recess 7 filling up to a small edge spacing, so that in a way that is not shown in more detail the printed circuit of the circuit board 4 can be connected directly to the electrical connection 8 of the magnetic coils 3, thus no additional wires or lines have to be laid within the housing 2. The assembly is also correspondingly simple and here it has proven to be favorable if the magnetic coils 3 engage partially in the circuit board 4 and if the remainder extends out opposite its bottom side, where the control components of the control circuit can also be soldered, so that the magnetic coils 3 can be soldered in the same way with its connections 8 to corresponding through-hole contact conductor tracks. Here, these conductor tracks can form through-hole contacts in the region of the connections 8 of the electromagnet 3 from the top side to the bottom side in order to be able to connect and solder on this bottom side of the circuit board with the control components to the connections 8 of the electromagnet 3.

According to FIGS. 7 and 8, the wires of the magnetic coils 3 are each wound on a plastic sleeve 9 and arranged between two plastic end covers 10 and 11, wherein the plastic cover 10 facing away from the driving end has a grounding plate 12, which is annular in the embodiment, which connects all of the magnetic coils 3, and which can be at least partially sunk into the plastic covers 10 for reducing overall height. The ferromagnetic cores 13 of the magnetic coils 3, which are located within the plastic sleeves 9 holding the windings, are here connected or riveted to this grounding plate 11.

The ferromagnetic cores 13 of the magnetic coils 3 here reach up to the driving ends and are there connected to flat pole plates or pole shoes 14, which in turn are especially flush with the plastic covers 11 arranged on the driving end for reducing overall height and thus are also flush with the top side of the circuit board 4. Thus, surprisingly high magnetic outputs can be achieved in a very tight space.

The diameter of the windings of the magnetic coils 3 is approximately twice as large as the axial dimension or larger according to FIGS. 7 and 8. The embodiment shows magnetic coils 3, whose diameters are approximately 3 times as large as its axial dimension.

Figure 10:
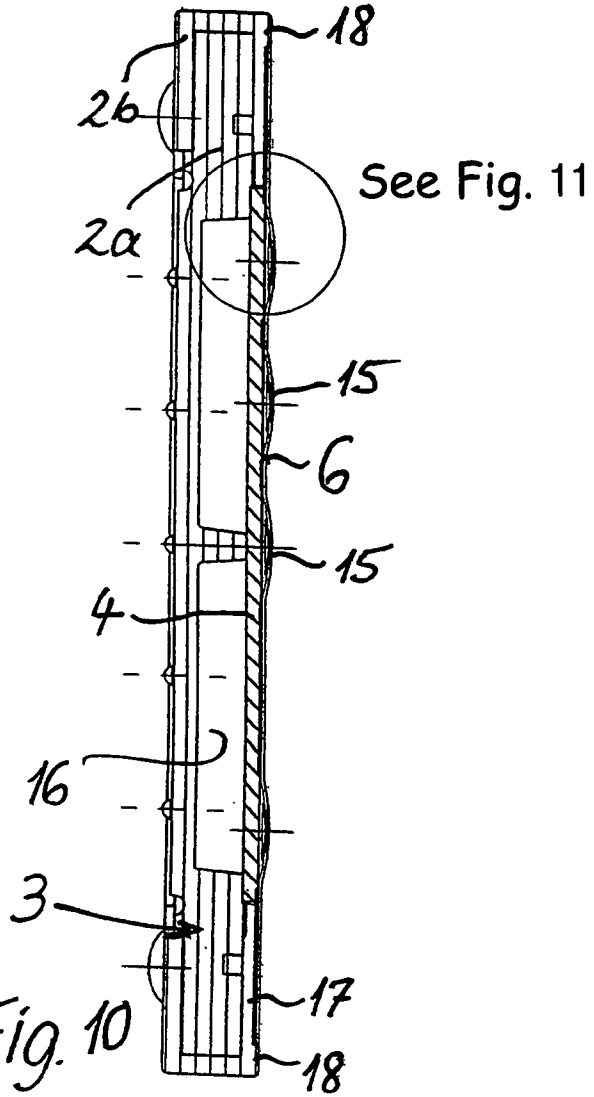
FIG. 10, is a cross section of the magnetic stirrer in the area of the control contacts and the cover arched through there embossing.
Figure 11:
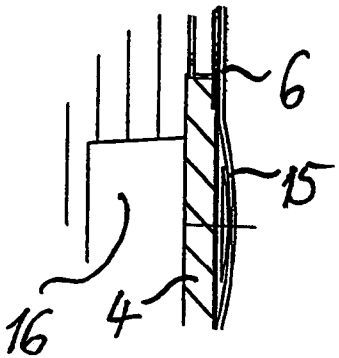
FIG. 11, is an enlarged view of, the detail specified by the circle referring to FIG. 11 in FIG. 10 with a section through the cover arched by embossing.
Figure 9:
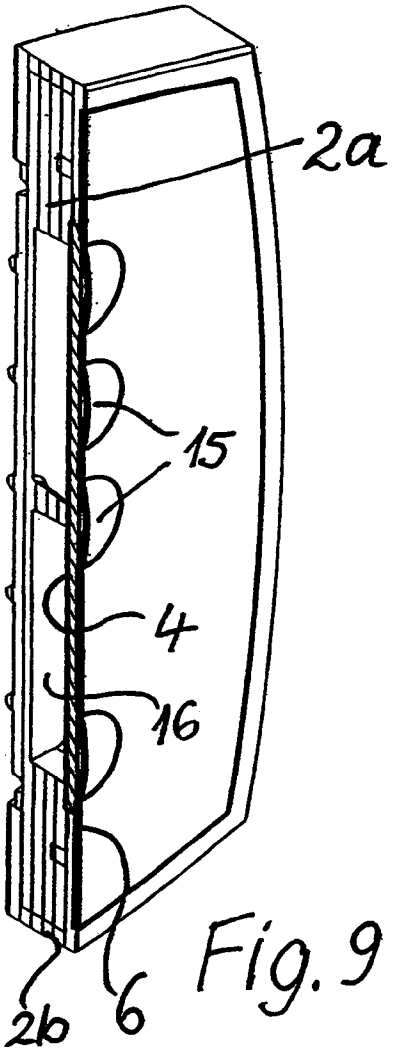
FIG. 9, is a graphical representation of a cross section with a top view of the magnetic stirrer in the region of the control contacts, wherein the cover, which is embossed and arched in the area of the control contacts, can also be seen in section.

As already explained, the cover is made from non-ferromagnetic material, in one embodiment a film or plastic film, especially an adhesive film which, according to FIGS. 9–11, can be embossed and arched as well as elastically pressed in the region of control contacts for the magnetic stirrer 1 is arranged on the top side of the circuit board 4 and not shown in more detail in the drawing. The control contacts on the top side of the control circuit board 4 are thus also covered and protected by this cover 6 formed as a film and can be activated such that the cover 6 has conductive material in a region on a bottom side of the arch 15 or is printed with conductive material, so that by means of slight pressure on the arch 15, the spacing between this conductive material and the area with the actual control contacts in the original position is eliminated and a connection is produced. Here it is favorable if a plastic film, which is provided with an embossed arch 15, has a certain elasticity, so that after an operating process the arch 15 automatically springs back to its original position due to the material restoring forces.

Figure 14:
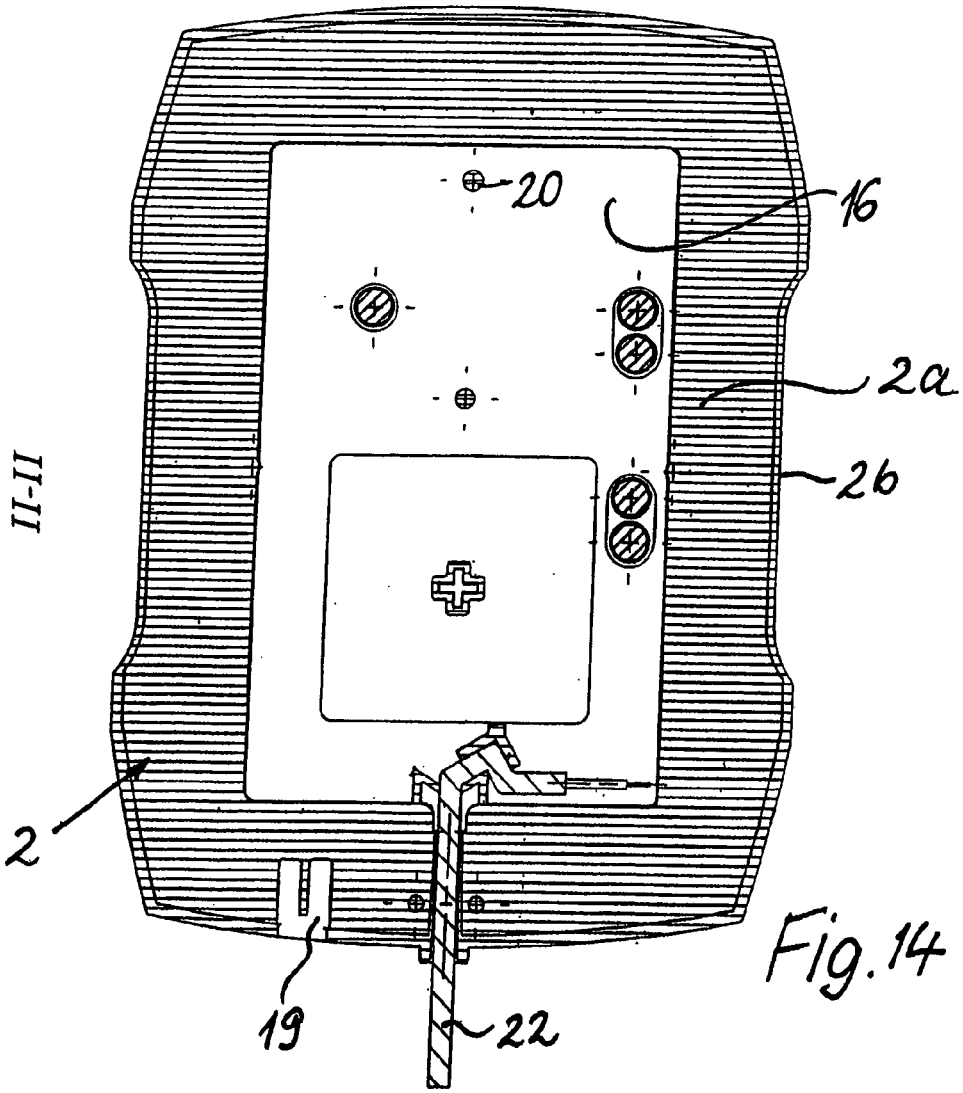
FIG. 14, is a horizontal section through the housing and the connection openings taken along the section line E—E in FIG. 12.

The housing 2 of the magnetic stirrer 1 is advantageously a plastic body, which has a recess 16 that can be identified particularly well in FIGS. 9–11 and in FIG. 14 for holding the control circuit board 4, the control components mounted on the bottom side of this board, and the magnetic coils 3. In FIGS. 1–5, this recess 16 is practically completely filled with the mentioned parts.

Here, one recognizes, primarily in FIGS. 1 and 2, a border 17, which encloses the recess 16, which is relatively wide, and which is gripped and covered by the cover 6 and whose surface is flush with the top side of the circuit board 4 and the driving ends of the magnetic coils 3, so that the recess 16 is sealed and closed by the cover 6 in the usable position, because the cover 6 or film is connected and adhered to this enclosing border 17 of the housing 2 and also to the control circuit board 4 and the driving ends of the magnetic coils 3 or electromagnets. Thus, the interior of the magnetic stirrer 1 is sealed tight and is also sealed dust-tight and liquid-tight in a simple way through the use of an adhesive film as the cover 6 for this closing of the recess 16 with the control and drive parts.

Here, one can see that the flat border 17 of the housing 2, which runs in the plane of the top side of the circuit board 4 and which supports the cover 6, has a slightly raised sealing edge 18, which encircles the entire border 17 enclosing the recess 16 in the embodiment and whose height in the embodiment corresponds to the thickness of the cover 6, so that the cover can reach up to the sealing edge 18, thus it has an outline shape, which corresponds to the inner contours of the raised sealing edge 18. The attachment of the cover 6 is also correspondingly simple, because it can be adapted to the raised sealing edge 18 and then lies advantageously in a common plane with the top side of the sealing edge 18 or if necessary can also extend slightly beyond the sealing edge.

Figure 12:
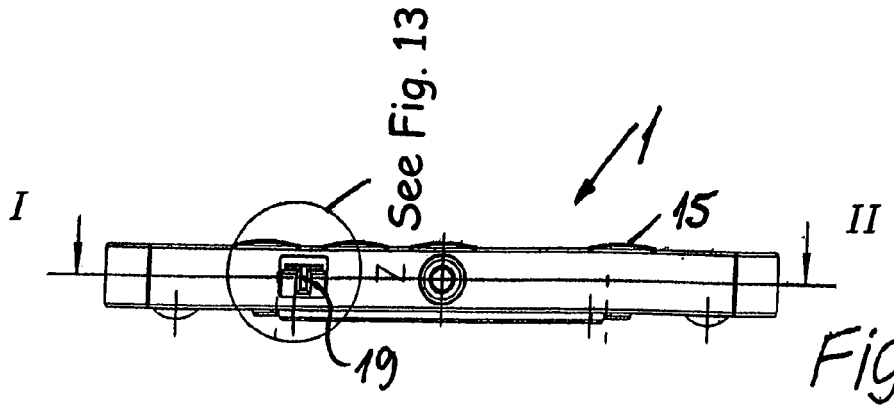
FIG. 12, is an end view of the plate-like magnetic stirrer in the region of its power connection and a connection for a grounding line.
Figure 13:
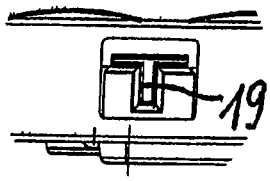
FIG. 13, is an enlarged view of, the detail specified by the circle referring to FIG. 13 in FIG. 12 with a view of the insertion opening of the connection for a grounding cable.

The plastic body used as the housing 2 can have a higher electrical conductivity value relative to conventional conductivity values for plastics and a connection 19 in the form of an insertion opening for a grounding line, which is represented in FIGS. 12–14 by connection 19.

Here, the embodiment further provides that the housing 2 has an inner housing part 2*a* made from hard or hardened plastic, which includes the recess or depression 16 for the circuit board 4 and the electromagnets 3, wherein this "inner" housing part 2*a* is embedded at least in sections in an external housing part 2*b* made from softer plastic or material, so that on the outer side of the magnetic stirrer 1, this softer, also impact-absorbing material encircles and protects the magnetic stirrer 1, and also makes it resistant to sliding.

The control circuit board 4 can be connected to the housing 2 or to the housing part 2*a* with the depression or recess 16, in addition to the fixing by the cover 6 or adhesive film, by a clamp. For this purpose, projections or pins 20 or the like can extend outwards from the housing part 2*a* within the depression 16. In the usable position, these projections engage tightly in matching recesses or through openings or holes 21 in the circuit board 4.

FIG. 14 shows another electrical connection cable 22 for the magnetic stirrer 1, which passes through one end of the housing 2 and which can also be better sealed through the softer material of the outer housing part 2*b*.

The cover 6 or cover film can have a surface that can be printed or written on in a way that is not shown in more detail, so that it can hold notes or also individual designations and decorative elements.

The magnetic stirrer 1 has a minimal overall height, so that it is approximately plate-shaped and flat and its electrical stirring drive formed by magnetic coils 3 is arranged approximately flush with the circuit board 4 with the control circuit, wherein the axial dimension of the magnetic coils 3 is less than its diameter. In addition, a cover 6 made from non-ferromagnetic material, especially an adhesive film, which seals the housing 2 tightly, is arranged over, and adhered to, the surface of the circuit board 4 and the driving ends of the magnetic coils 3 and lies in a common plane with an outer border 17 of the housing 2.

What is claimed is:

1. A magnetic stirrer (1) comprising a housing (2), which accommodates an electrical stirring drive comprising at least one alternately excitable magnetic coil (3) or electromagnet having a first end and a second end, as well as at least one circuit board (4) having a control circuit with control components for the stirring drive mounted on said board, a top, substantially horizontal contact surface (5) able to accommodate a container holding goods to be stirred as well as a stirring magnet, wherein the magnetic coils (3) are arranged below the contact surface (5) and a driving end of the at least one magnetic coil or electromagnet is located adjacent to the contact surface, wherein the driving end of the at least one magnetic coil (3) or electromagnet is approximately flush with at least one circuit board (4) the axial dimension of the at least one magnetic coil (3) or electromagnet is less than its diameter, and further comprises a cover (6) made from non-ferromagnetic material placed directly on or over the circuit board (4) and the driving end of the at least one magnetic coil (3) or electromagnet.

2. The magnetic stirrer of claim 1, wherein there are a plurality of the magnetic coils (3) or electromagnets and the driving ends of the plurality of the magnetic coils (3) or electromagnets are arranged in a common plane and are so arranged in the plane of a top side of the at least one control circuit board (4), which faces the contact surface (5) and which is horizontal in an operable position.

3. The magnetic stirrer of claim 1, wherein the at least one magnetic coil (3) or electromagnet extends downward past the at least one control circuit board (4) in an operable position.

4. The magnetic stirrer of claim 1, wherein the at least one magnetic coil (3) or electromagnet comprises a plurality of magnetic coils (3) or electromagnets arranged with axes parallel to each other and with the driving ends in the same plane engaged in a recess (7) or in a through hole in the circuit board (4), filling said recess or through hole up especially to an edge spacing, and comprises a printed circuit of the at least one circuit board (4) directly connected to electrical connections (8) of the coils (3) or electromagnets.

5. The magnetic stirrer of claim 4, wherein conductor tracks of the printed circuit of the at least one circuit board form through-hole contacts in the region of the connections (8) of the magnetic coils or electromagets (3) from a top side to a bottom side of the at least one circuit board and are connected or soldered on the bottom side of the at least one circuit board (4) having control components to the connections (8) of the magnetic coils or electromagnets (3).

6. The magnetic stirrer of claim 5, wherein the control components for the magnetic stirrer (1) are arranged on the top side of the control circuit board (4) and are covered by the cover, wherein the cover is (6) formed as a film and the cover (6) comprises conductive material in a region of the control components on a bottom side facing the contacts or is printed with a conductive pattern and further comprises spacing between the conductive region and the control components in an inactive position.

7. The magnetic stirrer of claim 6, wherein the cover (6) or film can be embossed or arched as well as elastically pressed in the region of the control components and can be brought into contact with the control components by a conductive bottom side thereof in the embossed region.

8. The magnetic stirrer of claim 6, wherein the cover (6) or cover film has a printable and/or writable surface.

9. The magnetic stirrer of claim 1, wherein the at least one magnetic coil (3) or electromagnet comprises a plurality of magnetic coils (3) or electromagnets that are each wound on a plastic sleeve (9) and are arranged between two plastic end covers (10, 11), wherein the plastic cover (10) facing away from the driving end has a grounding plate (12), which connects all of the magnetic coils (3) or electromagnets, which is sunk into the plastic cover (10), and which connects ferromagnetic cores (13) of the magnetic coils (3) or electromagnets, which are located within the plastic sleeves (9) holding the windings.

10. The magnetic stirrer of claim 9, wherein the ferromagnetic cores (13) of magnetic coils (3) or electromagnets reach up to the driving ends and are connected there to pole plates or pole shoes (14), that are flush with the plastic end covers (11) and arranged on the driving end.

11. The magnetic stirrer of claim 1, wherein the diameter of the windings of the magnetic coil (3) or electromagnet is approximately two to three times as large as an axial dimension of the magnetic coil or electromagnet.

12. The magnetic stirrer of claim 1, wherein the cover (6) is made from a non-ferromagnetic material.

13. The magnetic stirrer of claim 1, wherein the housing (2) of the magnetic stirrer (1) is formed from at least one plastic body with a recess (16) for holding the at least one control circuit board (4) and the magnetic coils (3) or electromagnets, wherein the plastic body has a border (17) enclosing the recess (16) and is sealed and closed by the cover or a film in the usable position.

14. The magnetic stirrer of claim 13, wherein on the horizontal border (17) of the housing supporting the cover (6) there is a raised, enclosing, sealing edge (18), whose height corresponds approximately to a thickness of the cover (6) or if necessary, exceeds it.

15. The magnetic stirrer of claim 1, wherein the cover (6) or film is connected or adhered, at least, to the enclosing border (17) of the housing (2), also to the control circuit board (4) and/or the driving ends of the magnetic coils (3) or electromagnets.

16. The magnetic stirrer of claim 15, wherein the border (17) of the housing (2) is arranged in a common plane with the top side of the circuit board (4) and/or the driving ends of the magnetic coils (3) or electromagnets.

17. The magnetic stirrer of claim 16, wherein the plastic body acting as a housing (2) is electrically conductive and further comprises a connection (19) for a grounding line.

18. The magnetic stirrer of claim 16, wherein the housing (2) has an inner housing part (2*a*) made from hard plastic with the recess or depression (16) for the circuit board (4) and the magnetic coils (3) or electromagnets and the inner housing part (2*a*) is embedded in an outer housing part (2*b*) made from softer material or plastic.

19. The magnetic stirrer of claim 17, wherein the at least one control circuit board (4) is connected to the housing (2) and/or to the housing part (2*a*) with the depression (16) by a clamp.

20. The magnetic stirrer of claim 17, wherein projections or pins (20) extend out from the housing part (2*a*) and in the usable position, the projections tightly engage in matching recesses, holes, or through holes in the circuit board (4).

* * * * *